US006546965B2

(12) United States Patent
Hamby et al.

(10) Patent No.: US 6,546,965 B2
(45) Date of Patent: Apr. 15, 2003

(54) INSTITUTIONAL TOWEL

(75) Inventors: David Eugene Hamby, Belton, SC (US); Wilbur Mattison Rice, Belton, SC (US)

(73) Assignee: Blair Mills, L.P., Belton, SC (US)

( * ) Notice: Subject to any disclaimer, the term of this patent is extended or adjusted under 35 U.S.C. 154(b) by 0 days.

(21) Appl. No.: 09/745,484

(22) Filed: Dec. 26, 2000

(65) Prior Publication Data

US 2002/0079014 A1 Jun. 27, 2002

(51) Int. Cl.[7] ..... D03D 27/08
(52) U.S. Cl. ..... 139/396; 139/1 R; 139/420 A
(58) Field of Search ..... 139/420 A, 1 R, 139/396

(56) References Cited

U.S. PATENT DOCUMENTS

| | | | |
|---|---|---|---|
| 3,721,272 A | 3/1973 | Hager | 139/396 |
| 3,721,273 A | 3/1973 | Sherrill et al. | 139/396 |
| 3,721,274 A | 3/1973 | Sherrill et al. | 139/396 |
| 4,185,959 A | 1/1980 | Imada et al. | 8/26 |
| 4,726,400 A | 2/1988 | Heiman | 139/396 |
| 6,062,272 A | 5/2000 | Waite | 139/420 |

FOREIGN PATENT DOCUMENTS

JP 61-79430 4/1986

OTHER PUBLICATIONS

Cover sheet from Delphion web–site, United States Patent No. 4,726,400 Of Standard Textile Company Inc. For: Terry–type cloth product an d method of making same.

Cover Sheet from Delphion web–site, United States Patent No. 4,185,959 Of Sumitomo Chemical Company, Limited For: Method for dyeing hydrophobic fiber material with disperse.

Cover sheet from Sina Pearson Textiles web–site "Care of Upholstery Fabrics".

Web–site article titled: KoSa Unveils New Speciality Fibers at IFFE.

Product information sheet: Martin Color–Fi Incorporated.

Press Release from internet: AlliedSignal Performance Fibers Expands Polyester Capacity.

Cover sheet from United States Patent Office web–site, Class 8 definition for: Bleaching and Dyeing; Fluid Treatment and Chemical Modification of Textiles and Fibers.

Cover sheet from United States Patent Office web–site, Class 139 definition for: "Textiles: Weaving".

"Topics in Applied Chemistry: The Chemistry and Application of Dyes", Edited by David R. Worring and Geoffrey Hallas, New York, Plenum Press, 1990. Section from chapter 7, Application of Dyes, by S.M. Burkinsha w.

*Primary Examiner*—John J. Calvert
*Assistant Examiner*—Robert H. Muromoto, Jr.
(74) *Attorney, Agent, or Firm*—Neil H. Hughes; Ivor M. Hughes; Marcelo K. Sarkis

(57) ABSTRACT

A coloured institutional towel comprising ground warp, fill, and pile warped yarns, all of said yarns being colored by intimately draw blending a predetermined amount of predyed polyester fiber with cotton fiber when the yarn is spun and twisted to thereby form a predetermined color for the institutional towel.

9 Claims, 2 Drawing Sheets

Process Flow Chart

INSTITUTIONAL TOWEL

FIELD OF THE INVENTION

This invention relates to a process for the manufacture of institutional towels with the resulting towel having a much longer life expectancy.

BACKGROUND OF THE INVENTION

It is well known to manufacture towels in a process utilizing yarn spun from 100% cotton fibres. In manufacturing such a towel, the yarn is woven, as is well known, on a loom with the 100% cotton yarn being contained in the ground, fill, and pile yarns. In fact it is the 100% cotton aspect of the towel that makes it more "desirable" by the consumer since it is fixed in the mind of the purchaser that 100% cotton towels are more absorbent than other types of towels. However, when considering an institutional towel there are many drawbacks to providing 100% cotton spun yarns woven into towels since there are other issues which must be considered, which from an institutional standpoint creates disadvantages to the institution, for example a hotel chain.

In manufacturing a typical towel through a continuous process, the towel is woven from the yarns accumulated on beams with the output from the loom being a continuous web of interconnected toweling product which must be bleached to remove any materials applied during the slashing process including a washing step. The toweling products are subsequently dyed through a cold pad batch or beck dying process, washed and finally dried, then separated and finished into towels, or other terry products.

The output therefore from the process includes towels of different colours including white, and various other shades. For a towel or a towel product for the retail market, the consumer is quite content to wash the coloured towels without bleaching and to apply a fabric softener either in the wash or in the dryer.

However, with institutional towels the concerns for the life expectancy of the towel becomes very important. Institutional towels are washed with bleach time after time and as a result it can be expected that the colour will fade after as little as ten washings with the colour being substantially gone after twenty washings. This is quite costly for the industry and therefore as a rule most institutional towels are white. By selecting a white colour, the towels may be washed over and over without the risk of fading. Further coloured institutional towels will fade, even without bleach, and will become unacceptable before they wear out.

It is known in the patent literature to provide a towel construction wherein it is suggested that yarns for ground fill, ground warp and the pile warp, although preferably being made of cotton, may also be manufactured from yarns made of blends of cotton and polyester. For example, U.S. Pat. No. 4,726,400 describes this alternative. It is also discussed within U.S. Pat. No. 4,726,400 that a checkered patent may be provided in the terry cloth by utilizing different colour yarns.

There is no discussion however as to how the yarns might be manufactured and coloured. We are also aware of other constructions for towels, for example U.S. Pat. No. 3,721,273 discusses in the Background of the Invention a preference of cotton and alternatively that synthetic fibres may be blended with the cotton fibres. Rayon yarns are also discussed in relation to their absorbency in that the rayon may be woven into the towel in the form of a 3-pick terry weave. U.S. Pat. No. 3,721,272 discusses that terry yarns have been formed of shrinkable synthetic fibres blended with cellulosic fibres, such as cotton. U.S. Pat. No. 3,721,274 teaches a woven terry towel wherein the ground warp and/or the filling yarns are composed of a blend of polyester and cellulosic fibres, but the terry pile is manufactured from 100% cotton. Within the reference is it stated that polyester has been heretofore considered an undesirable fibre for use in terry towels due to its low moisture absorbency characteristics. In fact, U.S. Pat. No. 6,062,272 issued May 16, 2000 teaches an all cotton pile with polyester being in the ground fabric. The pile yarns although desirably all cotton may include small quantities of other fibres such as polyester or rayon which would result in a corresponding decrease in the absorbency of the finished towel product. Specifically in the examples various compositions are described.

However, in spite of the general discussions in the above-mentioned patent literature there is no discussion of the present problems facing the institutions which purchase institutional towels. The towels used in for example, the hotel industry are generally white and if not white then they will be rendered unusable in twenty washing cycles. This is highly undesirable since most institutions bleach their laundry including towels for health reasons and would prefer to present the hotel guests with an attractive set of towels which have an unique colour and which colour match one another, other than a white set of towels.

It is therefore a primary object of this invention to provide an institutional towel and toweling products which are coloured and yet which are colour-fast.

It is a further object of this invention to provide an institutional towel and toweling product which is the result of a manufacturing process resulting in minimum variation from batch to batch of the final product colour.

It is a further object of this invention to provide an institutional towel that has a significantly longer life expectancy.

It is a further object o f this invention to provide an institutional towel ensemble which includes a matching set of toweling products having very little colour variation from item to item.

It is a further object of this invention to provide a process of manufacturing an institutional towel which eliminates the need to dye the towel at the towel mill.

Further and other objects of the invention may become apparent to those skilled in the art when considering the following summary of the invention and a more detailed description of the preferred embodiments illustrated herein.

SUMMARY OF THE INVENTION

According to a primary aspect of the invention there is provided a process for manufacturing toweling products comprising the steps of:

1) Providing cotton fibres;
2) Providing pre-dyed polyester fibres;
3) Orienting the fibres of the cotton in substantially a uniform parallel direction by carding;
4) Orienting the pre-dyed polyester fibres in substantially parallel direction by a carding process;
5) Draw blending the cotton and pre-dyed polyester fibres in a slivering process preferably in a ratio of 8 to 14% of the pre-dyed polyester fibres with the balance being the cotton fibre;
6) Following the intimate draw blending of the pre-dyed polyester and cotton fibres spinning the slivered fibres into twisted yarns having a pre-determined colour which will be imparted to the toweling product;

7) Accumulating the yarns on a loom beam following warping/slashing the yarns in preparation for the weaving process;

8) Weaving said coloured yarn into the ground warp, the fill and the pile warp yarns in the toweling product which preferably is a continuous process;

9) Preferably bleaching and subsequently washing and drying said toweling product prior to finishing;

wherein the colour in the toweling product is obtained by the weaving process only with no subsequent dying process being necessary and wherein the resulting towel products have i) a minimum colour variation from batch to batch, ii) are colour fast, the colour being imparted to the toweling product by the predyed polyester fibre allowing all institutional towels resulting from this process to be able to be washed and handled together, iii) a significantly longer life expectancy of the towel imparted by the polyester fibre, and iv) the ability of the toweling product to be manufactured into a matching set of toweling products having minimum colour variation from product to product.

The resulting institutional towel from this process overcomes many of the deficiencies and problems experienced in the institutional towel industry having a severe limitation in terms of white only in order to minimize the handling problem which would result should colours have to be separated.

In relation to life expectancy it has been, through experimentation, proven that such a towel manufactured for experimental purposes has undergone 100 washes with bleaching, but it has not lost it's luster and has not faded in spite of having been bleached. The towel was manufactured from the drawn blend yam of a vanilla colour.

The colour therefore in the institutional towel has been imparted to it by spinning yarns of a drawn blend of pre-dyed polyester fibres and natural cotton fibres. The resulting towel therefore is colour-fast, as a result, many times over those towels dyed in conventional manners. Typically as discussed in the background towels may be washed twenty times before one might expect the colour to be significantly altered. The experimental towels produced did not fade and retained their luster through 100 wash cycles.

According to yet another aspect of the invention there is provided an institutional coloured towel (and preferably manufactured from the above-mentioned process) which comprises coloured yarns draw blended of a pre-determined amount of pre-dyed polyester fibre with the remainder being natural cotton fibres resulting in a yarn of predetermined colour, said toweling product having ground warp, fill, and terry loop fibres manufactured from said yarn resulting in said institutional towel having a predetermined colour which is colour fast, has little variance from lot to lot, may be washed and bleached, is conveniently handled by an institution, has an increased life expectancy imparted by the polyester, and which has reproducible colour of the finished towel product from batch to batch.

It is therefore expected that other colours other than a vanilla colour obtained with the 12.5% brown pre-dyed polyester fibre may also be manufactured. Pastel shades of blue, red, green or the like may be manufactured in the form of an institutional towel which is superior when compared to known institutional towels of all cotton construction in terms of convenience and handling through the washing and bleaching cycles with the resulting increase in life expectancy while maintaining its colour and luster. The colour is reproducible from batch to batch and from product to product so that complete bath ensembles can be provided to the institution with matching colours from the face cloth, the bath towel and the hand towel and the bath mats.

According to yet another aspect of the invention there is provided a method of colouring a towel, and preferably an institutional towel, comprising weaving said towel from twisted yarn spun from an intimate, drawn blend of a predetermined amount of pre-dyed polyester fibre, preferably in the range of 8–14%, with the balance being cotton fibre, said coloured yarn thereafter being spun from said drawn blend and all of said ground yams, fill yarns and pile yarns making up said towel being formed from said drawn blended twisted coloured yarn to form said institutional towel which has the properties of: 1) being colourfast; 2) being consistent in colour from batch to batch; 3) being consistent in colour from towel product type to towel product type, for example, for a bath towel, face towel, wash cloth, and bath mat; 4) being capable of being bleached and washed without fading or loosing it's luster; and 5) having an extended life expectancy.

According to yet another aspect of the invention there is provided a towel and preferably an institutional towel, preferably manufactured from the above method comprising twisted yarn spun from an intimate, drawn blend of a predetermined amount of pre-dyed polyester fibre, preferably in the range of 8–14%, with the balance being cotton fibre, said coloured yarn thereafter being spun from said drawn blend and all of said ground yarns, fill yarns and pile yarns making up said towel being formed from said drawn blended twisted coloured yarn to form said institutional towel which has the properties of: 1) being colourfast; 2) being consistent in colour from batch to batch; 3) being consistent in colour from towel product type to towel product type, for example, for a bath towel, hand towel, wash cloth, and bath mat; 4) being capable of being bleached and washed without fading or loosing it's luster; and 5) having an extended life expectancy.

The aspect of providing a colour within an institutional towel is a considerable improvement for the hotel industry which no longer will be required to supply bland white towels or run the risk of having considerable expense if coloured towels are selected. By providing a towel by the above-mentioned method any pastel shade of towel can be manufactured including vanilla, pink, light blue, light green, grey and any other pastel type of shade without sacrificing a great deal of absorbency in the towel. It is considered that the advantages of such an institutional towel or for that matter a coloured towel in the retail trade are more than offset by the minimal loss in absorbency.

According to another aspect of the invention there is provided a coloured institutional towel comprising ground warp, fill, and pile warped yarns, all of said yarns being coloured by intimately draw blending a predetermined amount of pre-dyed polyester fibre with cotton fibre when the yarn is spun and twisted to thereby form a predetermined colour for the institutional towel.

For a preferred vanilla towel the twisted yarn includes a predetermined amount of predyed polyester fibre having a predetermined denier, and tenacity and fibre length. No limitations however to these variables is contemplated for use in the institutional towel. For the vanilla towel the predyed polyester fibre has a beige colour but as discussed it may have a different colour depending on the shade of towel desired. The colour of the predyed polyester is established by trial and error, and specified by a matching comparison with a coloured swatch. The predyed polyester/cotton draw blended twisted yarn is manufactured with a predetermined twist (turns per inch) in the yarn. The ground and fill yams may or may not have substantially the same twist as the pile yarns although they are of course of the same colour.

DETAILED DESCRIPTION OF THE PREFERRED EMBODIMENTS

Figure 1:
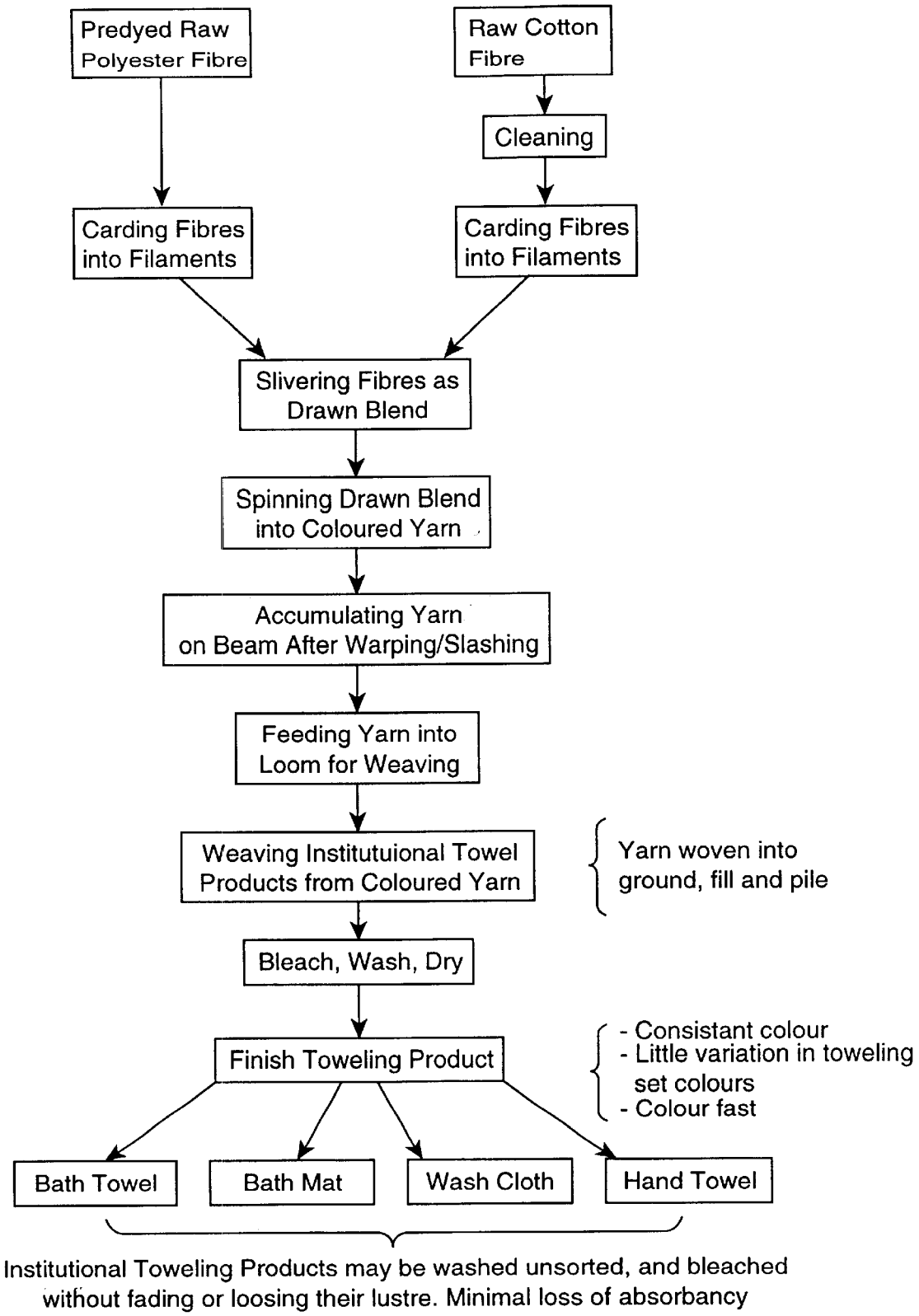
FIG. 1 is a flow chart of the Process of Manufacture of the present invention utilized in the manufacture of the Institutional Towel thereof.
Figure 2:
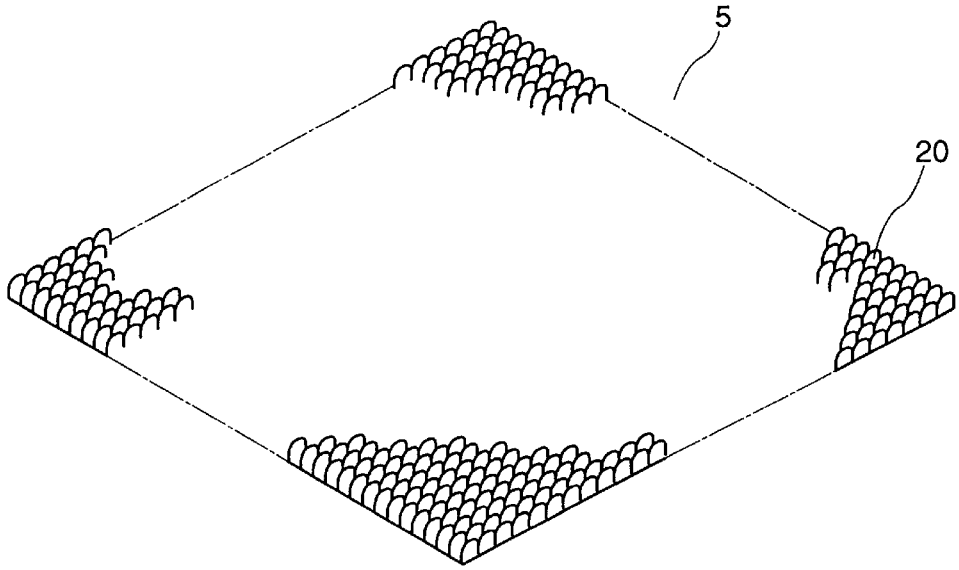
FIG. 2 is a schematic perspective view of the towel product manufactured from the process steps of FIG. 1.

Referring to FIG. 1, a process flow chart is illustrated which describes the manner in which the Institutional Towel is manufactured. The towel product (5) therefore of FIG. 2 is manufactured so as to overcome many of the deficiencies in prior institutional towels. As discussed in the Background of the Invention, most institutional towels are white because otherwise they would not stand up to the washing and bleaching cycles. It is appreciated that a towel product in a hotel, for example, would be washed on a daily basis. Should these towels and various towel products such as wash cloths, hand towels, bath towels, bath mats, bath robes, etc. be coloured, as is desirable, then they would have to be sorted out from the regular laundry flow and could not be subjected to bleaching. However, if they are not sorted then these toweling products would not stand up and the colour would fade by approximately 20 cycles.

Therefore, to address this problem, the present invention provides an Institutional Towel that is preferably vanilla in colour but may be other pastel shades such as grey, light blue, light green, yellow or the like. The toweling product formed by carrying out the process of FIG. 1 will have the preferred vanilla colour and will have very little shade variance from batch to batch of towels, and from batch to batch of matching toweling products making up a bath assemble. This minimum variation from batch to batch and from toweling product to toweling product is important especially after many washing cycles. It is desirable that the product stand up to the rigors of such washing and bleaching cycles and yet not fade, yet still matching the colour for the bath mat, bath towel, face towel, and wash clothes. It is also a result of this invention that the product is coloured without the necessity of carrying out a dying process at the towel mill. The resulting towel product stands up to many, many washings because of the extra strength imparted to the yarns by the presence of polyester. The polyester is distributed throughout the towel having been blended with cotton in manufacturing the yarn and therefore this strength and resilience of the product is distributed throughout all of the yarns including the ground, fill and pile yarns.

Referring to FIG. 1, the polyester is purchased in raw fibre form, with the fibres having been pre-dyed in this example to a brown colour, which when blended with the cotton fibres will result in a yarn having a vanilla colour. The materials are received in bales and the fibres are somewhat compacted as received. The fibres therefore must be separated sufficiently so as to be able to be properly handled. As is known, the cotton is cleaned. Once the fibres have been broken down in the sense that they have been separated and the bulk density thereof has been drastically reduced, they are in the form that they can be passed through a carding machine in order to take the fibres that are randomly distributed in the pre-dyed polyester and the cotton and to orient them in a generally parallel direction. The result of the carding process is that the fibres are laid out in a parallel direction in a long extended, untwisted rope like element. This is the case with both the pre-dyed polyester and the cotton. The continuous filaments therefore, having been carded are then accumulated to be fed through a slivering machine, and is utilized to create an intimate draw blend of the cotton and pre-dyed polyester carded fibres. The products are slivered together, that is to say draw blended, at a ratio of between 8 to 14% polyester, and the remainder being cotton. The resulting slivered element is continuous and is of considerable larger diameter than the prior carded products. The slivered continuous elements are therefore accumulated and fed into a yarn spinning machine, and the yarn product is spun from the intimately draw blended slivered mixture of polyester and cotton. The resulting twisted yarn is then accumulated again and processed through a warping/slashing process and coated with a compound to enable the yarn to stand up and impart to it a certain robust quality required during the weaving process. The yarn is therefore accumulated on a beam and fed to a loom for the toweling product to be manufactured. The ground yarn, the fill yarn and the pile yarns are all manufactured from the same coloured yarn intimately draw blended to provide the preferred vanilla colour. The resulting towel products are therefore finished and prepared for distribution, once the towels have been washed in caustic and bleached to remove the coating compound and dried to enable finishing. The resulting toweling products therefore have all of the desired qualities of the institutional towel product previously discussed with an unexpectedly much longer extended life than what might have been expected from the use of a draw blended yarn product that is pre-coloured. The towel product is therefore coloured without the necessity of including the dye step in the towel manufacturing process and the handling of chemicals required in order to do so. The safety within the mill therefore is enhanced and the product has proven by experimentation to be much superior to previously known institutional towels and towel products.

Figure 3:
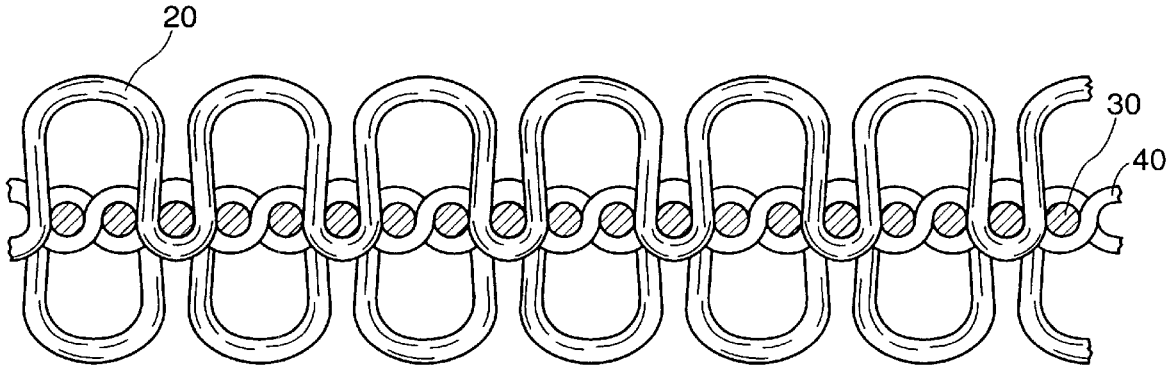
FIG. 3 is a close up perspective view of the yarn elements and how they are woven into the terry product illustrated in FIG. 2.

The coloured towel product (5) is illustrated in FIG. 2 with the preferred three pick weaving step shown in close up in FIG. 3 with all of the yarns shown in FIG. 3 therefore including the vanilla colour draw blended twisted yarn previously manufactured at the yarn mill. The towel product therefore includes the pile coloured yarns (20) the ground coloured yarns (30) and the fill coloured yarns (40) which are woven in a manner as is well known on a loom. All of the yarns are those which have a vanilla colour and contain an intimate draw blend of polyester and cotton. The coloured towel product preferably includes 75 threads per inch for the pile yarn, 60 threads per inch for the fill yarn and 45 threads per inch for the ground yarns. Up to three pile picks may be woven between two adjacent weft yarns of ground fabric. The result is a towel without an increase in the amount of polyester therein, but a different significant distribution which imparts the significant advantages identified above.

For the preferred vanilla towel (5) the twisted yarn (20, 30, 40) includes a predetermined amount of predyed polyester fibre having a predetermined denier, and tenacity and fibre length. No limitations however to these variables is contemplated for use in the institutional towel. For the vanilla towel (5) the predyed polyester fibre has a beige colour. The colour of the predyed polyester is established by trial and error, and specified by a matching comparison with a coloured swatch. The predyed polyester/cotton draw blended twisted yarn (20, 30, 40) are manufactured with a predetermined twist (turns per inch) in the yarns. The ground and fill yarns (30, 40) may or may not have substantially the same twist as the pile yarns (20) although they are of course of the same colour.

As many changes can be made to the preferred embodiment of the invention without departing from the scope thereof; it is intended that all matter contained herein be considered illustrative of the invention and not in a limiting sense.

The embodiments of the invention in which an exclusive property or privilege is claimed are as follows:

1. A process for manufacturing institutional toweling products having improved colour fastness and durability comprising the steps of:

1. providing natural cotton fibres;
2. providing pre-dyed polyester fibres;
3. orienting the fibres of the cotton in substantially a uniform parallel direction by carding;
4. orienting the pre-dyed polyester fibres in substantially parallel direction by a carding process;
5. draw blending the natural cotton and pre-dyed polyester fibres in a slivering process;
6. following the intimate draw blending of the pre-dyed polyester and natural cotton fibres spinning the slivered fibres into twisted yarns having a pre-determined colour which will be imparted to the toweling product;
7. accumulating the yarns on a loom beam following warping/slashing the yarns in preparation for the weaving process;
8. weaving said coloured yarn into the ground warp, the ground fill and the pile warp yarns in the toweling product in a continuous process;
9. bleaching and subsequently washing and drying said toweling product prior to finishing;

wherein the colour imparted to the institutional toweling product is obtained by the weaving of said draw blended yarn only with no subsequent dying process being necessary and wherein the resulting towel products have 1. a minimum colour variation from batch to batch,
   2. improved colour fastness, the colour being imparted to the toweling product by the pre-dyed polyester fibre allowing all institutional towels resulting from this process to be washed and handled together,
   3. a significantly longer life expectancy of the towel product imparted by the pre-dyed polyester fibre, and
   4. the ability of the toweling product to be manufactured into a matching set of toweling products having minimum colour variation from product to product.

2. A coloured institutional toweling product having improved colour fastness and durability comprising coloured yarns draw blended of a pre-determined amount of pre-dyed polyester fibre with the remainder being natural cotton fibres and resulting in yarn of pre-determined colour, said toweling product having ground warp, ground fill, and pile warp fibres, all being manufactured from said yarn resulting in said institutional toweling product having a pre-determined colour, said toweling product being colour fast, has little variance from lot to lot, may be washed and bleached, is conveniently handled by an institution, has an increased life expectancy imparted by the polyester, and which has reproducible colour of the finished toweling product from batch to batch.

3. The toweling product of claim 2 wherein complete bath ensembles are provided to the institution with substantially matching colours for the face towel, the bath towel, the hand towel and the bath mats.

4. The toweling product of claim 3 wherein the product colour is vanilla.

5. A method of colouring an institutional toweling product, comprising weaving said toweling product from twisted yarn blended from an intimate, draw blend of a predetermined amount of pre-dyed polyester fibre, with the balance being natural cotton fibre, said coloured yarn thereafter being spun from said draw blend and all of said ground warp yarns, ground fill yarns, and pile warp yarns making up said towel being formed from said drawn blended twisted coloured yarn to form said institutional toweling product which has the properties of: 1) being colourfast; 2) being consistent in colour from batch to batch; 3) being consistent in colour from towel product type to towel product type, for example, for a bath towel, hand towel, wash cloth, and bath mat; 4) being capable of being bleached and washed without fading or loosing it's luster; and 5) having an extended life expectancy.

6. An institutional toweling product comprising twisted yarn spun from an intimate, draw blend of a predetermined amount of pre-dyed polyester fibre, with the balance being natural cotton fibre, said yarn thereafter being spun from said drawn blend and all of said ground warp yarns, ground fill yarns and pile warp yarns making up said toweling product being formed from said draw blended twisted resultant coloured yarn to form said institutional toweling product which has the properties of: 1) being colourfast; 2) being consistent in colour from batch to batch; 3) being consistent in colour from towel product type to towel product type, for example, for a bath towel, face towel, wash cloth, and bath mat; 4) being capable of being bleached and washed without fading or loosing it's luster; and 5) having an extended life expectancy.

7. A colour fast institutional toweling product comprising ground warp, ground fill, and pile warp yarns, all of said yarns being coloured by intimately draw blending a predetermined amount of pre-dyed polyester fibre with natural cotton fibre when the yarn is spun and twisted to thereby form a predetermined coloured yarn for subsequently weaving the colour fast institutional toweling product.

8. The toweling product of claim 2, 6 or 7 wherein the product colour is vanilla.

9. An institutional toweling product comprising ground fill, ground warp, and pile warp yarns all of which are spun from a draw blend of pre-dyed polyester and natural cotton fibres wherein the colour imparted to the institutional toweling product is provided by said yarns only without the need for further processing.

* * * * *

UNITED STATES PATENT AND TRADEMARK OFFICE

CERTIFICATE OF CORRECTION

PATENT NO. : 6,546,965 B2 
DATED : April 15, 2003
INVENTOR(S) : David Eugene Hamby and Wilbur Mattison Rice It is certified that error appears in the above-identified patent and that said Letters Patent is hereby corrected as shown below:

Column 7,
Line 61, please delete "." and insert -- ; -- and thereafter please insert -- wherein 8 to 14% pre-dyed polyester is utilized in manufacturing the yarns imparting the colour to said toweling product. --

Column 8,
Lines 10, 33, 48, 55 and 64, please delete "." and insert -- ; --, and thereafter please insert -- wherein 8 to 14% pre-dyed polyester is utilized in manufacturing the yarns imparting the colour to said toweling product. --

Signed and Sealed this

First Day of June, 2004

JON W. DUDAS
*Acting Director of the United States Patent and Trademark Office*